US005494053A

United States Patent [19]

Dawson et al.

[11] Patent Number: 5,494,053

[45] Date of Patent: Feb. 27, 1996

[54] CIGARETTE MAKING MACHINE

[75] Inventors: John Dawson; Derek H. Dyett, both of High Wycombe, Great Britain

[73] Assignee: Molins PLC, Milton Keynes, England

[21] Appl. No.: 338,144

[22] Filed: Nov. 9, 1994

[30] Foreign Application Priority Data

Nov. 10, 1993 [GB] United Kingdom ..... 9323145

[51] Int. Cl.[6] ..... A24C 5/14; A24C 5/18

[52] U.S. Cl. ..... 131/84.1; 131/84.3

[58] Field of Search ..... 131/84.1–84.4, 131/108

[56] References Cited

FOREIGN PATENT DOCUMENTS 2942119 4/1981 Germany ..... 131/84.3

2023401 1/1980 United Kingdom ..... 131/84.3

*Primary Examiner*—jennifer Bahr

*Attorney, Agent, or Firm*—Antonelli, Terry, Stout & Kraus

[57] ABSTRACT

A cigarette making machine includes a suction conveyor arranged to carry a tobacco filler stream which is substantially wider than its depth, a suction chamber situated downstream of the zone in which the filler stream is formed on the conveyor or received by the conveyor and arranged to induce an air flow through the filler stream and also along the filler stream, whereby tobacco from peaks in the filler stream tends to be carried forward and to be attracted to the conveyor by suction drawn through the conveyor in regions of less tobacco, and including structure for subsequently reducing the width and increasing the depth of the filler stream before the filler stream is conveyed to a rod-forming pad of the machine in which the filler stream (possibly after trimming) is enclosed in a wrapper web to form a continuous cigarette rod.

15 Claims, 2 Drawing Sheets

Fig.5.
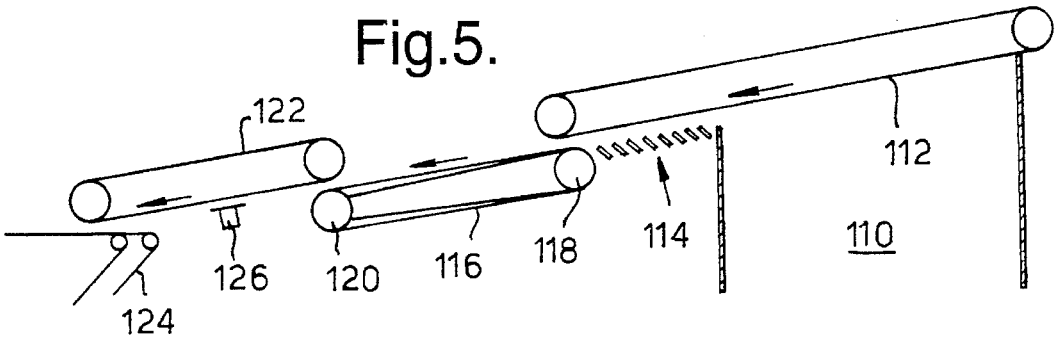
Fig.6.
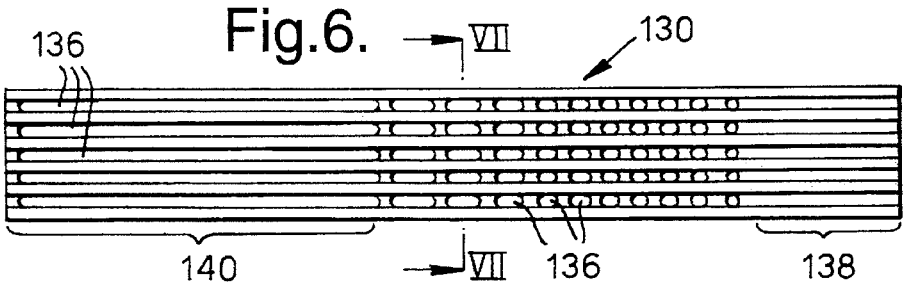
Fig.7.
Fig.8.
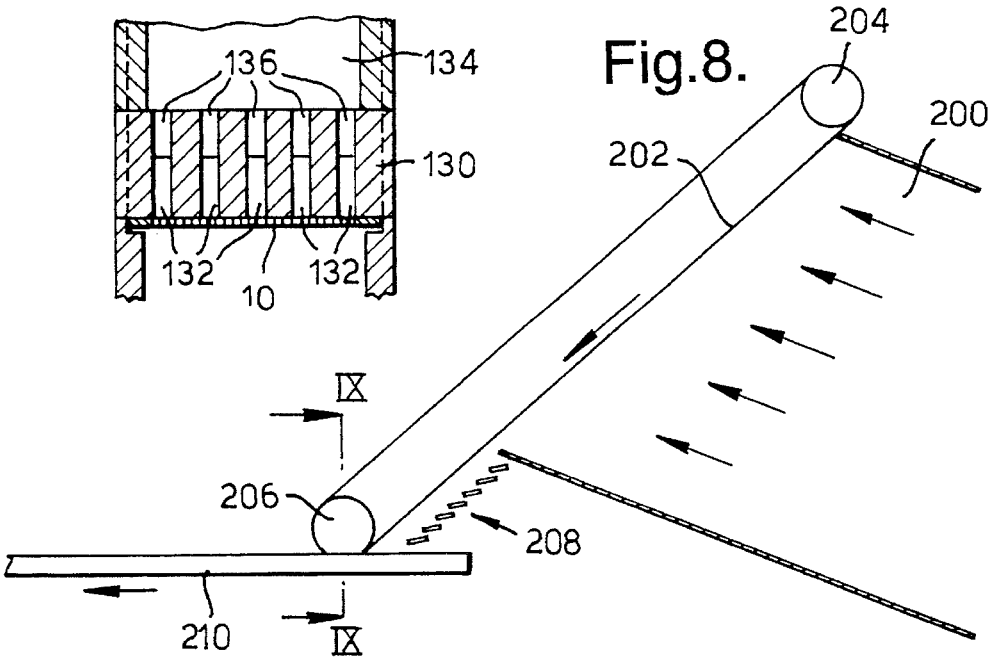
Fig.9.
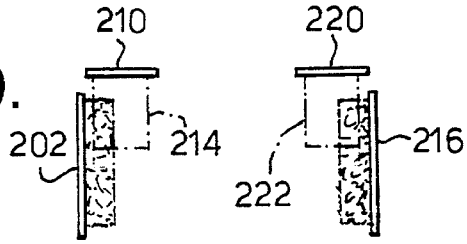

CIGARETTE MAKING MACHINE

This invention is concerned with the formation of a cigarette filler stream from tobacco showered towards a conveyor, usually a suction band, which conveys the filler stream towards a rod-forming device in which the filler stream, possibly after being trimmed, is enclosed in a continuous wrapper web to form a continuous cigarette rod. This rod is subsequently cut at regular intervals to form individual cigarette portions or double-length portions.

A cigarette making machine according to the present invention comprises a suction conveyor arranged to carry a tobacco filler stream which is substantially wider than its depth, a suction chamber situated downstream of the zone in which the filler stream is formed on the conveyor or received by the conveyor and arranged to induce an air flow through the filler stream and also along the filler stream, whereby tobacco from peaks in the filler stream tends to be carried forward and to be attracted to the conveyor by suction drawn through the conveyor in regions of less tobacco, and including means for subsequently reducing the width and increasing the depth of the filler stream before the filler stream is conveyed to a rod-forming part of the machine in which the filler stream (possibly after trimming)is enclosed in a wrapper web to form a continuous cigarette rod.

The filler stream may be formed by showering tobacco, for example upwards, through a shower channel directly onto the suction conveyor and is held on the conveyor by suction. The upward movement of the tobacco through the shower channel may be induced partly or entirely by the suction drawn through the conveyor in the region above the shower channel.

Downstream of this shower channel, the level of suction above the conveyor may be substantially reduced so that the filler stream is attracted relatively lightly to the conveyor. This allows excess tobacco from peaks in the filler stream to be drawn forward by the air flow already described. This air flow may be induced substantially entirely by the suction applied through the conveyor from a high-level suction chamber, which suction is preferably significantly higher than the suction applied through the conveyor above the shower channel. Between the shower channel and the high-level suction chamber, suction is preferably applied to the conveyor by a lower-level suction chamber in which the suction level is substantially lower than the suction level above the shower channel.

Alternatively, a common suction chamber may extend along the suction conveyor downstream of the shower channel (and possibly also along the shower channel), and suction may be transmitted through the conveyor via apertures of varying sizes to control the air flow rate. Suction transmission apertures may be omitted where tobacco peaks are required to be separated for redistribution in areas of less tobacco.

The width of the initially formed filler stream is preferably at least about twice that of the filler stream as it enters the rod-forming device. For example, the initial width may be approximately 18 mm, and this may be reduced to approximately 8 mm before the filler stream enters the rod forming device.

The filler stream may be carried into the rod-forming device (the "garniture") by the conveyor on which it is initially formed; in this case the conveyor, after the filler stream has been reduced in width, is preferably changed progressively in cross-section to a convex shape so that its edges are upwardly directed to reduce the effective width of the conveyor as it enters the garniture. Alternatively, the filler stream may be transferred from the first conveyor to a narrower second conveyor arranged to carry the narrowed filler stream into the garniture.

This invention may also be applied to each of the tobacco sub-streams formed respectively on two converging suction bands and then merged to form a complete cigarette filler stream in the manner generally described in our British patent No. 2,221,137.

Although we believe that any need for the usual trimming of the filler stream may be obviated by the redistribution of excess tobacco in the manner described above, a trimmer may be applied to remove excess tobacco from the narrowed filler stream before it is enclosed in the wrapper web.

Examples of cigarette making machines according to this invention will now be described with reference to the accompanying drawings. In these drawings:

FIG. 5 is a diagrammatic front view of a different machine;

FIG. 6 is an enlarged view of part of the machine shown in FIG. 1 or FIG. 5;

FIG. 7 is an enlarged cross-section on the line VII—VII in FIG. 6;

FIG. 8 is a diagrammatic plan view of part of another different machine; and FIG. 9 is an enlarged cross-section on the line IX—IX in FIG. 8.

Figure 1:
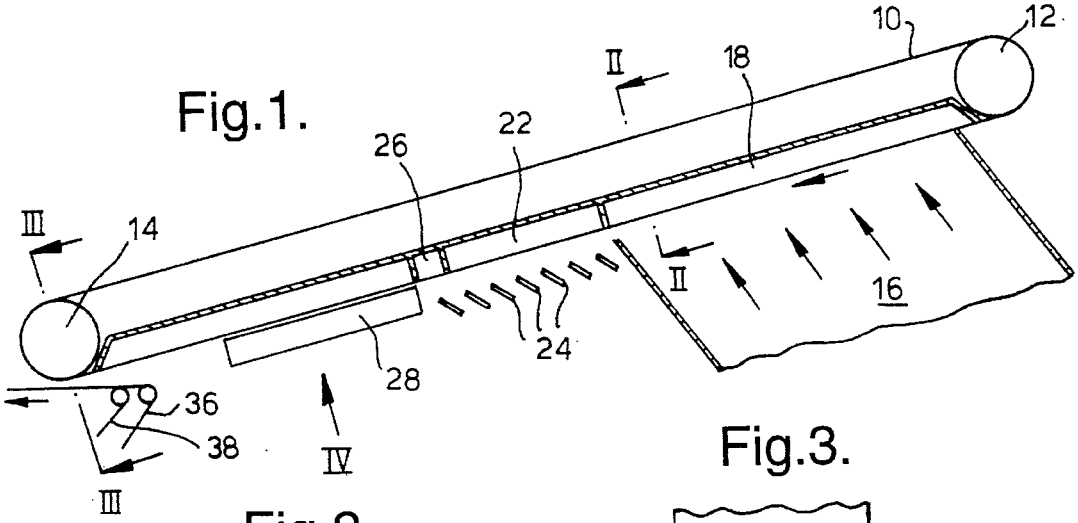
FIG. 1 shows a diagrammatic front view of a machine according to this invention.

The machine shown in FIG. 1 comprises a conveyor in the form of a suction band 10 arranged to pass around pulleys 12 and 14, and a shower channel 16 through which tobacco is showered generally upwards to form a filler stream 20 (see FIG. 2) on the underneath surface of the band 10. It should be noted that the shower channel 16 is inclined significantly to the vertical so that tobacco arrives on the band 10 in a direction having a component in the direction of movement of the band 10; it may alternatively be vertical.

Figure 2:
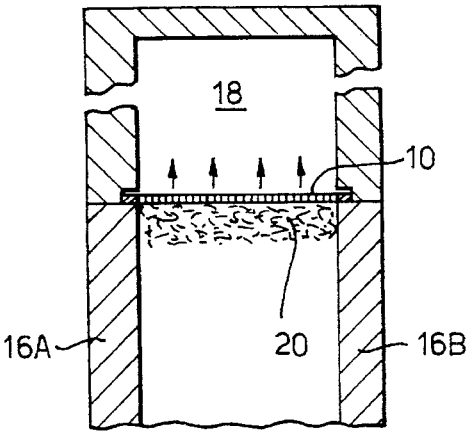
FIG. 2 is an enlarged cross-section of part of the machine on the line II—II in FIG. 1.

An upward air flow through the channel 16 is induced entirely by suction applied through the band from a suction chamber 18. In other words, the supercharger (a louvre below the suction band communicating with a separate suction source) commonly used in Molins machines such as the Mark 9 is omitted, though a supercharger may in fact be included if desired. The supercharger may be omitted since the relatively thin tobacco stream allows sufficient air to be drawn through it. The approximate cross-sectional shape of the filler stream 20 formed on the band 10 is shown in FIG. 2. This cross-section is approximate in that the depth of the filler stream (i.e. measured normal to the band 10) varies. The average depth may be approximately 4 mm, while the width defined by side walls 16A and 16B in this example is 18 mm.

Immediately downstream of the shower channel 16, the filler stream is held lightly on the conveyor 10 by suction applied through a low-level suction chamber 22. Below the filler stream in this region there are air inlet vanes 24 which are inclined to the band 10 so as to introduce air into the space above the vanes in a direction having a component in the direction of movement of the band and filler stream. Air is induced through the vanes partly by suction in the chamber 22 but more particularly by suction applied through the band from a high-level suction chamber 26. The suction levels in the chambers 22 and 26 may, for example, be respectively approximately 4 to 6 inches (10–15 cms) and 40 inches (100 cms) water gauge.

As a result mainly of the high level of suction applied through the band by the suction chamber 26, an air flow is caused to pass along the lower surface of the filler stream in the direction of movement of the band 10 and at a higher velocity. This removes tobacco from peaks in the filler stream, and at least some of such tobacco is attracted into valleys in the filler stream represented by thinner portions of the filler stream. Consequently the filler stream, as it proceeds beyond the suction chamber 26, has a more even depth and it is believed possible to omit the usual trimming of the filler stream, though trimming may be used, if desired, for example as described below with reference to FIG. 5.

Figure 4:
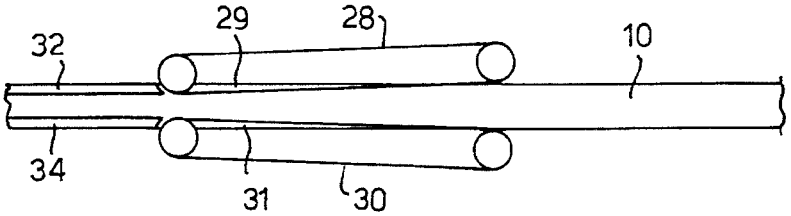
FIG. 4 is an enlarged underneath view of part of the machine in the region of the arrow IV in FIG. 1.

As shown particularly in FIG. 4, the filler stream is then reduced in width (and consequently increased in depth) by converging bands 28 and 30, after which the filler stream is confined at its sides by rails 32 and 34 substantially until the filler stream is deposited on a wrapper web 36 (FIG. 1) which is carried through the garniture of the machine (not shown) by a garniture tape 38. To aid the inward gathering of the filler stream tobacco by the converging bands 28 and 30, suction is blanked off from the band 10 in the triangular regions 29 and 31. Alternatively, instead of no suction being applied through the band 10 in those regions, air may be blown downwards through the band from appropriately formed pressure chambers above the band, while suction is applied to the band in the region between the opposed adjacent active runs of the bands 28 and 30.

Figure 3:
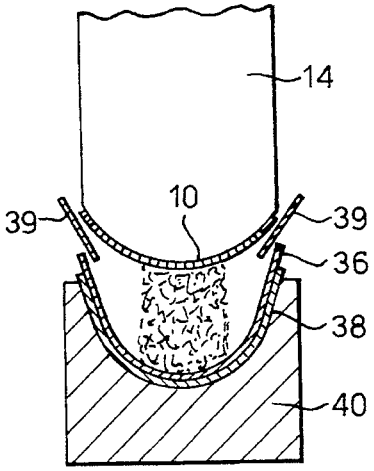
FIG. 3 is an enlarged cross-section of part of the machine on the line III—III in FIG. 1.

As shown in FIG. 3, the pulley 14 has a convex peripheral cross-section so that the edge portions of the band 10 are inclined upwards to reduce the effective width of the band 10 as it delivers the filler stream onto the wrapper web. At this stage, the garniture tape 38, and accordingly also the wrapper web 36, is concave in cross-section. Fixed guides 39 prevent contact between the edges of the band 10 and the paper 36. The garniture tape is supported by a garniture bed 40 which defines the cross-sectional shape of the tape; this shape becomes progressively more deeply concave while the filler stream, after leaving the band 10, is compressed and further shaped by the usual tongue (not shown).

Instead of the pulley 14 having a fixed-radius cross-sectional curve at its periphery, as shown in FIG. 3, its peripheral cross-section may have other shapes such as to allow the edges of the band to be deflected upwards as the band approaches the garniture. For example, a central region of the periphery of the pulley may be flat in cross-section and the outer regions may be curved or inclined upwards (as viewed in the FIG. 3 cross-section) or may be upwardly recessed.

A further possibility is that the filler stream may initially be formed on the band 10 with a narrow width and correspondingly greater depth, may be trimmed while in that form (i.e. shortly after passing the shower channel), and may then be spread sideways pneumatically to form approximately the cross-section shown in FIG. 2; for example,, as described with reference to FIG. 15 to 17 of our British patent specification 2,269,975. Any unevenness in the depth of the tobacco thereafter would then tend to be evened out by the action of the air flow induced by the high-level suction chamber 26 as described above.

FIG. 5 shows a different machine. In this example, tobacco is showered up a channel 110 to form a wide but shallow filler stream (as illustrated in FIG. 2) on the underneath surface of a suction band 112. A tobacco redistribution process is applied to the filler stream in a region 114, this being possibly as described with reference to the first example or alternatively as described below with reference to FIGS. 6 and 7, and the filler stream is then transferred onto a suction band 116. This band may have a width similar to that of the band 112, and it acts to reduce the width of the filler stream effectively by folding it as the filler stream moves between pulleys 118 and 120 around which the band 116 passes. For this purpose, the pulley 120 has a concave peripheral cross-section and the band 112 is of suitably flexible material (for example, woven nylon) so that the cross-sectional shape of the band 116 becomes progressively more deeply concave as it passes between the pulleys 118 and 120, thus folding the filler stream into a narrow formation. In this form the filler stream is transferred to the underneath surface of a narrow suction band 122 which carries the filler stream onto a wrapper web 124. A trimmer 126 may be provided to trim the filler stream while it is being carried by the band 122; this trimming operation may serve mainly or partly to form the filler stream with regularly spaced dense end portions at positions corresponding to the ends of the finished cigarettes.

Instead of tobacco redistribution being achieved by means of low-level and high-level suction chambers 22 and 26 as described with reference to FIG. 1, the following alternative may be used. A single suction chamber extends along the combined length of the suction chambers 22 and 26 in FIG. 1, and suction is transmitted from this chamber through the band 10 via apertures in a band support member, which apertures are of larger cross-section towards the downstream end (or in a region corresponding to the suction chamber 26), thus allowing air to be drawn through the band at a higher rate in that region. An example of such an arrangement is illustrated in FIGS. 6 and 7.

FIG. 6 is an enlarged underneath view of part of a band support member extending effectively along the combined length of the suction chambers 22 and 26 in FIG. 1 or the region 114 in FIG. 5. This member is formed in its lower surface with a number of parallel grooves 132, as shown in FIG. 7. The lands between these grooves form support surfaces for the suction band 10. Suction is transmitted through the band 10 from a suction chamber 134 via apertures 136 opening out into each of the grooves.

In FIG. 6 the width of the band support member 130 in relation to its length is shown somewhat exaggerated for the purpose of clear illustration.

The band support member 130, along an upstream region 138, has no such apertures, while the apertures in a downstream region 140 are in the form of continuous slots so as to transmit suction with the least possible pressure drop. Between the regions 138 and 140, the apertures increase progressively in length so that the level of suction applied to the band 10 (or the air drawn through the band 10) increases progressively as the band moves from the region 138 (in which suction is temporarily not applied to the band) to the region 140, in which full suction is applied to the band.

The region 138 along which no suction is applied to the band is relatively short (for example, 25–50 mm) and we have found that cutting off suction to the band briefly is helpful in ensuring that tobacco forming peaks in the filler stream is able to separate and be accelerated faster than the band 10 by the flow of air induced by suction applied particularly through the region 140 of the band support member 130. As in FIG. 1, vanes 24 are provided to allow air to enter the space above them with a component of motion in the direction of movement of the band, and it is this air that accelerates the tobacco which is redistributed from peaks to valleys in the filler stream.

By way of example, the region 140 of the band support member 130 may have a length of approximately 75–100 mm, and the intermediate region between the regions 138 and 140 may have a similar length as illustrated in FIG. 6.

FIG. 8 is a plan view of a different form of machine according to this invention. Tobacco in this example is showered substantially horizontally through a shower channel 200 to form a wide but shallow filler stream on a suction band 202 passing around pulleys 204 and 206 which have substantially vertical axes of rotation. The filler stream formed in this way may be similar to that shown in FIG. 2, and the machine includes a redistribution area 208 which may correspond to the arrangement shown in FIG. 1 or that described with reference to FIG. 6 and 7. The filler stream is then transferred to a narrow overhead suction band 210 which carries the filler stream onto the wrapper web (not shown). While being carried by the band 210, the filler stream may be trimmed as described with reference to FIG. 5.

FIG. 9 illustrates the change of filler stream cross-section in the region of the transfer from the band 202 to the band 210. As shown in FIG. 9, the band 202 is vertically orientated in cross-section and carries a wide but shallow filler stream 212. This transforms into a narrower but deeper filler stream on the band 210 of which an approximate outline 214 is shown.

FIG. 9 also illustrates the possibility of a second wide band 216 being provided to form a filler stream 218 which is transferred to a second overhead band 220 to form a second cigarette rod parallel to the first rod. The arrangement for this purpose, in plan view, would be substantially a mirror image of that shown in FIG. 8. A machine in that form would have certain similarities with some of the machines described in our patent specifications GB 2221137B, GB 2243529B and GB 2269975A. The machines in each of those cases are concerned with using two converging suction bands to form two tobacco sub-streams which are merged to form a single cigarette filler stream. Nevertheless, reference is directed to those specifications to the extent that features disclosed in them may be applicable to the example described above with reference to FIGS. 8 and 9.

We claim:

1. A cigarette making machine comprising a suction conveyor arranged to carry a tobacco filler stream which is substantially wider than its depth, a suction chamber situated downstream of the zone in which the filler stream is formed on the conveyor or received by the conveyor and arranged to induce an air flow through the filler stream and also along the filler stream, whereby tobacco from peaks in the filler stream tends to be carried forward and to be attracted to the conveyor by suction drawn through the conveyor in regions of less tobacco, and including means for subsequently reducing the width and increasing the depth of the filler stream before the filler stream is conveyed to a rod-forming part of the machine in which the filler stream is enclosed in a wrapper web to form a continuous cigarette rod.

2. A machine according to claim 1 in which the width of the filler stream, before it is reduced, is at least twice the average depth of the filler stream.

3. A machine according to claim 2 in which the width of the filler stream, before it is reduced, is at least three times the average depth of the filler stream.

4. A machine according to claim 2 in which the width of the filler stream, before it is reduced, is at least four times the average depth of the filler stream.

5. A machine according to claim 1, in which air forming the air flow along the filler stream is drawn through inclined vanes or other means whereby it enters the space adjacent to the filler stream with a component of motion in the direction of movement of the conveyor.

6. A machine according to claim 1, in which the air flow is induced partly or mainly by suction applied through the conveyor from a high-level suction chamber formed downstream of a lower-level suction chamber.

7. A machine according to claim 1, in which suction for retaining the filler stream on the conveyor is reduced or cut off along a portion of the path of the conveyor to enable tobacco from peaks in the filler stream to separate and be carried forward by the air flow.

8. A machine according to claim 1, including a conveyor support member formed with apertures of increasing size through which an increasing flow of air is induced through the filler stream from a suction chamber on the side of the support member remote from the conveyor.

9. A machine according to claim 1, in which the means for reducing the width of the filler stream comprises converging conveyors.

10. A machine according to claim 1, in which, for the purpose of reducing the width of the filler stream, the filler stream is carried by a conveyor which starts flat in cross-section and becomes progressively concave to fold the filler stream into a narrower form.

11. A machine according to claim 10, in which the filler stream is formed initially on one conveyor, is transferred to the conveyor by which it is folded into a narrower form, and is then received by a third conveyor which carries the filler stream onto a wrapper web.

12. A machine according to claim 1, arranged to form the filler stream by showering tobacco substantially horizontally onto a substantially horizontal moving suction conveyor of which the tobacco receiving surface is substantially vertical in cross-section, the filler stream being formed into a narrower formation by being transferred from the first-mentioned conveyor to a narrower overhead suction conveyor which carries the filler stream on its underneath surface and onto a wrapper web.

13. A machine according to claim 1, further comprising means for trimming the filler stream before the filler stream is enclosed in the wrapper web.

14. A method of manufacturing cigarettes, in which a filler stream is formed having a width substantially greater than its depth measured normal to the surface of the conveyor carrying the filler stream, and suction is drawn through the conveyor so as to induce an air flow through the filler stream and also along the filler stream, whereby tobacco from peaks in the filler stream tends to be carried along the filler stream and to be attracted to the conveyor by suction drawn through the conveyor in regions of less tobacco, and the width of the filler stream is then decreased and the depth is increased before the filler stream is enclosed in a wrapper web to form a continuous cigarette rod.

15. A method according to claim 14, further comprising a step of trimming the filler stream prior to enclosing the filler stream in the wrapper web.

* * * * *